United States Patent [19]

Ogawa

[11] Patent Number: 4,669,668

[45] Date of Patent: Jun. 2, 1987

[54] FUEL INJECTOR FOR INTERNAL COMBUSTION ENGINES

[75] Inventor: Masanobu Ogawa, Higashi-Matsuyama, Japan

[73] Assignee: Diesel Kiki Co., Ltd., Tokyo, Japan

[21] Appl. No.: 810,692

[22] Filed: Dec. 18, 1985

[30] Foreign Application Priority Data

Dec. 21, 1984 [JP] Japan ..... 59-270265

[51] Int. Cl.[4] ..... F02M 47/00; F02M 61/20

[52] U.S. Cl. ..... 239/533.5; 239/533.8; 239/533.9

[58] Field of Search ..... 239/553.3–553.9, 239/553.11, 553.12

[56] References Cited

U.S. PATENT DOCUMENTS

| | | | |
|---|---|---|---|
| 4,081,140 | 3/1978 | Kranc | 239/533.9 |
| 4,225,088 | 9/1980 | Kulke et al. | 239/533.5 |
| 4,285,471 | 8/1981 | Eblen et al. | 239/533.4 |
| 4,448,356 | 5/1984 | Nakajima et al. | 239/533.5 |
| 4,461,427 | 6/1984 | Kopsé et al. | 239/533.5 |
| 4,572,434 | 2/1986 | Seifert | 239/533.12 |

FOREIGN PATENT DOCUMENTS

| | | | |
|---|---|---|---|
| 2118624 | 11/1983 | United Kingdom | 239/533.3 |

*Primary Examiner*—Andres Kashnikow
*Assistant Examiner*—MaryBeth O. Jones
*Attorney, Agent, or Firm*—Wenderoth, Lind & Ponack

[57] ABSTRACT

A fuel injector for internal combustion engines comprising an improved valve structure whose valve-opening pressure is directly proportional to the fuel pressure. The fuel injector includes a nozzle holder having a valve seat, a needle valve moveably mounted in the nozzle holder and biased against the valve seat by a nozzle spring acting on a moveable spring seat fitted therebetween, a plunger moveably mounted in the nozzle holder and having one end on which fuel pressure acts, an actuator rod disposed between the plunger and moveable spring seat with a small distance provided between the actuator rod and the spring seat, and a plunger spring acting on the plunger to urge the latter against the fuel pressure acting on the plunger. The plunger spring is stronger than the nozzle spring acting on the needle valve, such that the needle valve is lifted by the small distance until the fuel pressure acting on the needle valve exceeds a combined force of the force of the nozzle spring and the fuel pressure acting on the plunger. Thereafter, as the fuel pressure increases, the nozzle valve is further lifted by a valve-opening pressure which is directly proportional to the fuel pressure.

18 Claims, 2 Drawing Figures

FUEL INJECTOR FOR INTERNAL COMBUSTION ENGINES

BACKGROUND OF THE INVENTION

1. Field of the Invention

The present invention relates to a fuel injector for an internal combustion engine such as a diesel engine.

2. Prior Art

Most conventional fuel injectors comprise an automatically operating valve including a needle valve pressed against a valve seat by a spring. The fuel pressure acts upon an intermediate tapered shoulder of the needle valve, so that, when the spring pressure is overcome, the needle valve is raised some distance above the valve seat and the fuel is injected into the combustion chamber of an internal combustion engine through an aperture thus formed. In such an automatically operating valve, the valve-opening pressure is always constant not only at low engine speeds but also at high engine speeds. Therefore, it is difficult to effect injection at a low rate when the engine is idling or operates for a relatively long period or effect injection at a high rate when the engine is in a high load range during which the fuel is injected for a relatively short period.

With the foregoing difficulty in view, the present assignee has proposed a two-stage fuel injector comprising a valve operative at two different valve-opening pressures. This injector houses two springs in its nozzle holder, one of which counteracts to the fuel pressure to limit the lift of a needle valve at the initial stage of fuel injector followed by the main injection occurring when the fuel pressure overcomes a combined force of the two springs.

In the two-stage fuel injector shown in Japanese Utility Model Laid-open Publication No. 57-186657, two pairs of springs and associated movable spring seats are disposed in series to act in such a manner that at the initial injection stage, the first spring seat is lifted by a distance $\Delta 1$ against the force of the first spring resting on the first spring seat, and at the end of the initial inspection stage, the first spring seat is further lifted to raise the second spring seat by a distance $1-\Delta 1$ against the force of the second spring resting on the second spring seat. With this arrangement, when the engine is idling or operates under low load condition, inspection is effected at two stages (initial and full injections) to provide a low inspection rate, thereby stabilizing low speed engine operation. The two stage engine fuel injection does not take place when the engine operates at high speeds and under heavy loads because the valve-opening pressure and therefore the combined force of the first and second springs is constant. Thus, the two-stage fuel injector is still not satisfactory in that an instant, high pressure fuel injection is difficult to achieve when the engine operates at high speeds and under heavy loads.

SUMMARY OF THE INVENTION

It is accordingly an object of the present invention to provide a fuel injector including a valve structure operative at a valve-opening pressure varying in proportion to the fuel pressure.

Another object of the present invention is to provide a fuel injection capable of effecting fuel injector in such a manner that when the engine is idling or operates at low speeds, a certain quantity of fuel is injected for a relatively long time to achieve a low injection rate, whereas the fuel is injected instantly at a high injection rate during high speed operation of the engine under a heavy load.

According to the invention, the foregoing and other objects are attained, by a fuel injector comprising: a nozzle holder having a valve seat; a needle valve movably disposed in said nozzle holder and normally urged against said valve seat by a nozzle spring via a movable spring seat disposed between said needle valve and said nozzle spring, said needle valve being adapted to be lifted by a first distance to effect fuel injection in response to the pressure of fuel supplied to said fuel injector, a plunger movably disposed in said nozzle holder and having one end on which the fuel pressure acts; an actuator rod disposed between said spring seat and said plunger and normally spaced a second distance from one of said spring seat and said plunger, said second distance being smaller than said first distance; and a plunger spring disposed in said nozzle holder, stronger than said nozzle spring, and acting on the other end of said plunger to urge the latter against the fuel pressure acting on said plunger.

With this construction, when the engine is idling or operating at low speeds, the fuel pressure is relatively low so that the needle valve is lifted by the second distance against the force of the nozzle spring until the spring seat, the actuator rod and the plunger engine are brought into mutual engagement with one another. Because of the greater force of the plunger spring than the fuel pressure, a further lift of the needle valve is prevented so that fuel injection continues for a relatively long time through a relatively small valve opening, thereby providing a low injection rate which ensures a stable engine combustion. Under heavy load and high speed engine operating conditions, an increased quantity of fuel is supplied to the injector and high fuel pressure acts on the plunger to urge the latter against the force of the plunger spring until the plunger, the actuator rod and the spring seat are brought into mutual engagement with one another. Now, the valve-opening pressure and hence the combined force of the plunger spring varies in proportion to the fuel pressure. Thus, the fuel is injected instantly at a high injection rate, whereby atomization of fuel is promoted.

Many other advantages and features of the present invention will become apparent with reference to the detailed description and the accompanying sheets of drawings in which a preferred structural embodiment of the invention is shown by way of an illustrative example.

DETAILED DESCRIPTION OF THE PREFERRED EMBODIMENT

Figure 1:
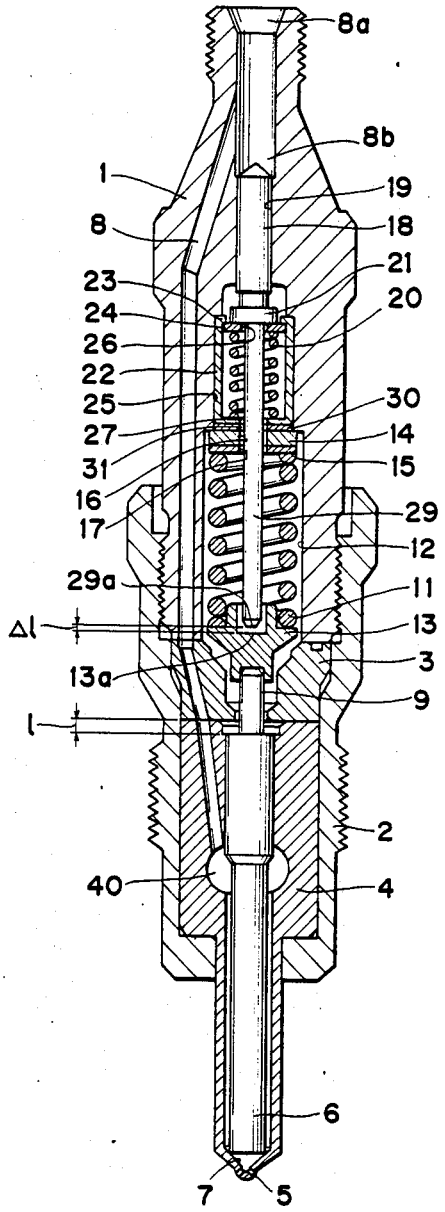
FIG. 1 is a longitudinal cross-sectional view of a fuel injector according to the present invention.

As shown in FIG. 1, a fuel injector embodying the present invention includes a nozzle holder 1 and a nozzle body 4 connected together by a nozzle nut 2 with an intermediate annular piece 3 disposed between the nozzle holder 1 and the nozzle body 4, the nozzle body 4 having at its bottom an aperture 5 from which fuel is ejected. Valve means including a needle valve 6 is slidably disposed in an axial internal passage or bore (not designated) in the nozzle body 4 and has a bottom end pressed against a valve seat 7 formed along said passage of nozzle body 4 by means of spring means comprising a compression nozzle spring 11 thereby closing the aperture 5. The needle valve 6 also has an intermediate taper shoulder on which the fuel pressure acts to move the needle valve 6 in a first direction. The taper shoulder and an inner peripheral wall of the nozzle body 4 define therebetween a pressure chamber 40 into which fuel is supplied under pressure from a fuel injection pump (not shown) through a first fuel passage 8. The top end of the needle valve 6 is held in engagement with a movable spring seat 13 via a push rod 9 formed integrally with the needle valve 6. The nozzle spring 11 is seated on the spring seat 13 to depress the latter until the needle valve 6 engages the valve seat 7. The needle valve 6 is adapted to be lifted up to a first distance 1 until the top end of the needle valve 6 abuts against the lower end of the intermediate piece 3.

The nozzle holder 1 has an axial spring chamber 12 for receiving the nozzle spring 11. The spring seat 13 is received in a lower end portion of the spring chamber 12 and is rested on the push rod 9 of the needle valve 6 so as to transfer the force of the nozzle spring 11 to the needle valve 6, thereby setting a valve-opening pressure. In the illustrated embodiment, the valve-opening pressure is set at about 160 kg/cm$^2$ for a stable combustion at low engine speeds. The upper end of the nozzle spring 11 is retained on an upper spring seat 14 held in abutment with an annular stepped shoulder of the nozzle holder 1 with valve-opening pressure adjusting melans comprising a shim or spacer ring 15 interposed between the spring seat 14 and the nozzle spring 11 for adjusting the valve-opening pressure. The upper spring seat 14 and the shim 15 have central holes 16, 17, respectively.

The valve means further includes a plunger 18 disposed in an upper end portion of the nozzle holder 1 for receiving the pressure of fuel delivered from the fuel injection pump. In the illustrated embodiment, the plunger 18 is slidably disposed in an axial fuel passage 19 connected to a second fuel passage **8*b*, which is branched from the first fuel passage 8 immediately adjacent to a fuel inlet 8*a***.

The plunger 18 is urged by a plunger spring 20 in a direction which is opposite to the direction of movement of the plunger 18 when the latter is subjected to a high fuel pressure acting thereon. More specifically, the plunger 18 has at its lower end an annular flange 21 held in abutment with a spring seat 24 urged upwardly by the plunger spring 20.

The spring means further includes a plunger spring 20 which is serially arranged with the nozzle spring 11 and is disposed in a tubular retainer 22 with an upper end thereof abutting with an annular shoulder or stop 23 of the retainer 22 via the spring seat 24, the lower end of the plunger spring 20 being seated on an annular bottom end of the retainer 22. The tubular retainer 22 is fitted in an axial bore 25 communicating coaxially with an upper end of the spring chamber 12. The spring seat 24 and the bottom end of the retainer 22 have central holes 26, 27, respectively.

An actuator rod 29 projects integrally and coaxially from the lower end of the plunger 18 and extends into the spring chamber 12 successively through the hole 26 of the spring seat 24, the hole 27 of the bottom end of the retainer, the hole 31 of an annular shim or spacer 30 disposed between the retainer 22 and the spring seat 14, the hole 16 of the spring seat 14, the hole 17 of the adjustment shim 15. The actuator rod 29 has a distal end **29*a* disposed opposite to an upper surface 13*a* of the movable spring seat 13 with a second distance (pre-lift) $\Delta 1$ provided therebetween. The pre-lift $\Delta 1$ is adjustable by replacing the pre-lift adjustment shim 30** with another shim having a different thickness.

The plunger 18 is designed to start moving downwardly when the fuel pressure in a delivery pipe (not shown) is greater than about 220 kg/cm$^2$ and the valve-opening pressure of the needle valve 6 is equal to 160 kg/cm$^2$, however, when the fuel pressure is greater than 220 kg/cm$^2$, the plunger 18 is displaced downwardly against the force of the plunger spring 20 until the actuator rod 29 abuts against the upper surface **13*a* of the movable spring seat 13 to cancel out the pre-lift $\Delta 1$. Thereafter the valve-opening pressure of the needle valve 6 is changed as a combined force of the fuel pressure and the pressure exerted by the nozzle spring 11, which varies in proportion to the fuel pressure applied to the plunger 18**.

With the fuel injector thus constructed, the fuel is supplied from the fuel injection pump into the pressure chamber 40 through the first fuel passage 8. In a low load and low speed engine operation range such as idling, the fuel pressure in the pressure chamber gradually increases. When the fuel pressure becomes greater than the force of the nozzle spring 11 and therefore the valve-opening pressure (160 kg/cm$^2$ in the illustrated embodiment), the needle valve 8 is lifted by the distance $\Delta 1$ until the upper surface **13*a* of the movable spring seat 13 engages the distal end 29*a* of the actuator rod 29**.

During that time, the plunger 18 is subjected to the fuel pressure, however, even when the fuel pressure becomes greater than 160 kg/cm$^2$ but below 220 kg/cm$^2$, the plunger 18 is kept immovable under the force of the plunger spring 20. Thus, the pre-lift $\Delta 1$ of the needle valve 6 is maintained. As appears from the foregoing, a further lift (full lift 1) takes place only when the fuel pressure in the pressure chamber 40 exceeds a combined force of the force of the nozzle spring 11 and the fuel pressure acting on the plunger 18.

In a low load and low speed engine operation range, an increase in fuel pressure is relatively low so that the needle valve 6 is maintained in the pre-lifted condition. Thus, fuel is injected at a low injection rate through a relatively small opening provided between the needle valve 6 and the valve seat 7. With the low injection rate thus provided, a stable engine combustion in the low speed range is achieved.

Figure 2:
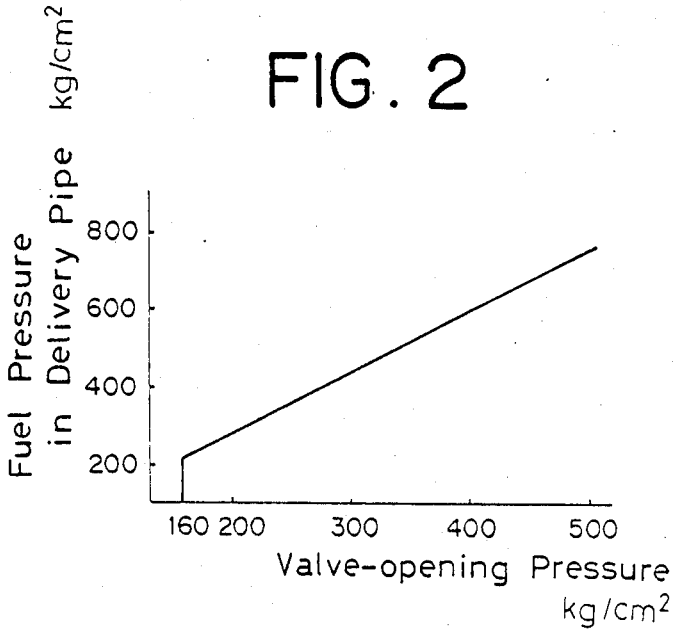
FIG. 2 is a graph showing some perspective of the fuel injector shown in FIG. 1.

Under heavy load, high speed engine operating condition, an increased degree of fuel pressure is applied to the plunger 18 whereupon the plunger 18 is moved downwardly against the force of the plunger spring 20 to bring the distal end **29*a* of the actuator rod 29 into engagement with the upper surface 13*a* of the movable spring seat 13 before the needle valve 6 is lifted to open the aperture 5. Now, the pre-lift or the distance $\Delta 1$ is canceled out or becomes zero, therefore, the needle valve 6 is subjected to a combined force of the predetermined force of the nozzle spring 11 and the force applied on the plunger 18 (which corresponds to a force obtained by subtracting the force of the plunger spring 20 from the fuel pressure). The needle valve 6 is lifted by the distance 1 when the fuel pressure overcomes the combined force. The valve-opening pressure of the needle valve 6 is proportional to the pressure applied to the plunger 18** with the result that the valve-opening pressure increases as the increase of the fuel pressure as shown in FIG. 2.

When the valve-opening pressure in a low load and speed range so set at 160 kg/cm$^2$, a higher valve-opening pressure such as 400–500 kg/cm$^2$ is available in a heavy load and high speed range. The increased valve-opening pressure enables injection of fuel for short period at a high pressure, thereby achieving a high injection rate.

As described above, according to the present invention, the opening-pressure of the needle valve is controlled to vary in proportion to the pressure of fuel supplied for injection, throughout the engine operation from the low load and low speed range to the heavy load and high speed range. Partly because of the valve-opening pressure is determined solely by the force of the nozzle spring without the influence of the fuel pressure, and partly because of the limited lift of the needle valve, it is possible to extend the injection period and also to lower the injection rate, thereby improving the engine combustion during low load, low speed operation of the engine. Due to the valve-opening pressure being proportional to the fuel pressure, the injection period in the heavy load and high speed range is shortened as the fuel pressure increases. Accordingly, the fuel is injected at a high pressure and high injection rate which leads to fine atomization of injected fuel.

Obviously, many modifications and variations of the present invention are possible in light of the above teachings. It is therefore to be understood that within the scope of the appended claims, the invention may be practiced otherwise than as specifically described.

What is claimed is:

1. A fuel injector comprising:

(a) a nozzle holder;

(b) a nozzle body having a valve seat formed along a passage through said nozzle body, said nozzle body being connected to said nozzle holder;

(c) a needle valve movably disposed in said passage in said nozzle body, a nozzle spring positioned to normally urge said needle valve against said valve seat, a movable spring seat disposed between said needle valve and said nozzle spring, said needle valve being adapted to be moved away from said valve seat up to a first distance to effect fuel injection in response to the pressure of fuel applied to said fuel injector;

(d) said nozzle body and said needle valve jointly defining therebetween a pressure chamber in fluid communication with said passage, said nozzle holder having a fuel inlet, a first fuel passage extending from said fuel inlet to said pressure chamber, and a second fuel passage branching from said first passage at a portion thereof adjacent to said fuel inlet;

(e) a plunger slidably disposed in said second fuel passage and movable in response to fuel pressure from said fuel inlet towards said needle valve;

(f) an actuator rod extending coaxially from one end of said plunger, said actuator rod having a free end disposed a second distance from a surface on said movable spring seat, said second distance being smaller than said first distance;

(g) a plunger spring disposed in said nozzle holder, said plunger spring having a spring force which is greater than that of said nozzle spring, said plunger spring connected to said plunger to urge said plunger against the fuel pressure from said second fuel passage acting on said plunger.

2. A fuel injector according to claim 1, wherein said nozzle spring and said plunger spring are disposed around said actuator rod in axial alignment with each other for co-action with each other.

3. A fuel injector according to claim 2, including at least one adjustment shim disposed between said nozzle spring and said plunger spring for adjusting said second distance.

4. A fuel injection nozzle assembly comprising:

housing means including fuel inlet means for receiving pressurized fuel from a fuel pump, a pressure chamber, a first passage for fluid communication of said fuel inlet means with said pressure chamber, fuel outlet means including a valve seat in fluid communication with said pressure chamber for delivery of fuel to the combustion chamber of an engine, and a second passage in fluid communication with said fuel inlet means;

valve means disposed in said housing means for controlling flow of fuel from said pressure chamber to said fuel outlet means, said valve means including a needle valve disposed in said pressure chamber and movable up to a first distance in a first direction away from said valve seat in response to pressure of fuel in said pressure chamber, said valve means further including a plunger disposed in said second passage, said plunger being movable a second distance, which is less than said first distance, towards and engageable with said needle valve in response to pressure of fuel in said fuel inlet means; and spring means including a first spring disposed in said housing means for biasing said needle valve against said valve seat and preventing movement of said needle valve in said first direction until pressure of fuel in said pressure chamber exceeds a spring force of said first spring, said spring means further including a second spring for preventing movement of said plunger towards said needle valve until pressure of fuel in said fuel inlet means exceeds a spring force of said second spring, said spring force of said second spring being greater than said spring force of said first spring.

5. The fuel injection nozzle assembly of claim 4, wherein a movable spring seat engages said first spring and said needle valve, said movable spring seat being separated from an end of said plunger by said second distance.

6. The fuel injection nozzle assembly of claim 5, wherein shim means is interposed between said second spring and said first spring for adjusting said second distance.

7. The fuel injection nozzle assembly of claim 6, wherein said plunger includes an annular flange disposed intermediate said one end thereof and an opposite end thereof disposed in said second passage, said second spring engaging said annular flange to counteract pressure on said opposite end of said plunger due to pressure of fuel in said second passage.

8. The fuel injection nozzle assembly of claim 4, wherein said housing means includes an axial spring chamber for said first spring and an axial bore for said second spring, said axial bore being disposed between said second passage and said axial spring chamber and said plunger extending through said axial bore and into said axial spring chamber.

9. The fuel injection nozzle assembly of claim 8, wherein a movable spring seat engages said first spring and said needle valve, said movable spring seat being separated from an end of said plunger by said second distance.

10. The fuel injection nozzle assembly of claim 9, wherein shim means is interposed between said second spring and said first spring for adjusting said second distance.

11. The fuel injection nozzle assembly of claim 10, wherein said plunger includes an annular flange disposed intermediate said one end thereof and an opposite end thereof disposed in said second passage, said second spring engaging said annular flange to counteract pressure on said opposite end of said plunger due to pressure of fuel in said second passage.

12. The fuel injection nozzle assembly of claim 8, wherein a spring seat is disposed between one end of said first spring and an end of said axial spring chamber and a movable spring seat is disposed between the opposite end of said first spring and said needle valve.

13. The fuel injection nozzle assembly of claim 12, wherein valve-opening pressure adjusting means is disposed between said spring seat and said one end of said first spring.

14. The fuel injection nozzle assembly of claim 13, wherein a movable spring seat engages said first spring and said needle valve, said movable spring seat being separated from an end of said plunger by said second distance.

15. The fuel injection nozzle assembly of claim 14, wherein shim means is interposed between said second spring and said first spring for adjusting said second distance.

16. The fuel injection nozzle assembly of claim 8, further comprising a tubular retainer disposed in said axial bore, said tubular retainer having an annular shoulder, a spring seat disposed between one end of said second spring and said annular shoulder and said tubular retainer having an end spaced from said annular shoulder engaging the other end of said second spring.

17. The fuel injection nozzle assembly of claim 16, wherein said plunger includes an annular flange disposed between said axial bore and said second passage, said annular flange engaging said spring seat disposed between said one end of said second spring and said annular shoulder of said tubular retainer.

18. The fuel injection nozzle assembly of claim 4, wherein said first spring and said second spring are serially arranged in said housing means with said plunger extending coaxially through said second spring and said first spring.

* * * * *